US011306486B2

(12) United States Patent
Nilsson et al.

(10) Patent No.: US 11,306,486 B2
(45) Date of Patent: Apr. 19, 2022

(54) RESILIENT FLOOR

(71) Applicant: VALINGE INNOVATION AB, Viken (SE)

(72) Inventors: Mats Nilsson, Viken (SE); Per Nygren, Ramlosa (SE)

(73) Assignee: VALINGE INNOVATION AB, Viken (SE)

( * ) Notice: Subject to any disclaimer, the term of this patent is extended or adjusted under 35 U.S.C. 154(b) by 183 days.

(21) Appl. No.: 16/713,431

(22) Filed: Dec. 13, 2019

(65) Prior Publication Data

US 2020/0362567 A1 Nov. 19, 2020

Related U.S. Application Data

(63) Continuation of application No. 16/027,465, filed on Jul. 5, 2018, now Pat. No. 10,526,793, which is a continuation of application No. 14/982,608, filed on Dec. 29, 2015, now Pat. No. 10,047,527, which is a continuation of application No. 14/272,895, filed on May 8, 2014, now Pat. No. 9,249,581, which is a continuation of application No. 13/734,406, filed on (Continued)

(51) Int. Cl.

| | |
|---|---|
| ***E04F 15/02*** | (2006.01) |
| ***E04F 15/10*** | (2006.01) |
| ***E04B 5/00*** | (2006.01) |

(52) U.S. Cl.

CPC ..... *E04F 15/02038* (2013.01); *E04B 5/00* (2013.01); *E04F 15/10* (2013.01); *E04F 15/105* (2013.01); *E04F 2201/0138* (2013.01); *E04F 2201/0146* (2013.01); *E04F 2201/0153* (2013.01); *Y10T 29/49623* (2015.01)

(58) Field of Classification Search

CPC ... E04F 15/02038; E04F 15/10; E04F 15/105; E04F 2201/0138; E04F 2201/0146; E04F 2201/0153; E04B 5/00; Y10T 29/49623

See application file for complete search history.

(56) References Cited

U.S. PATENT DOCUMENTS

| | | | |
|---|---|---|---|
| 1,787,027 | A | 12/1930 | Wasleff |
| 3,077,703 | A | 2/1963 | Bergstrom |

(Continued)

FOREIGN PATENT DOCUMENTS

| | | |
|---|---|---|
| CA | 2456513 A1 | 2/2003 |
| DE | 2 251 762 | 5/1974 |

(Continued)

OTHER PUBLICATIONS

U.S. Appl. No. 16/887,559, **Whispell et al.—See Information Below.

(Continued)

*Primary Examiner* — Adriana Figueroa

(74) *Attorney, Agent, or Firm* — Buchanan Ingersoll & Rooney P.C.

(57) ABSTRACT

A method of assembling resilient floorboards is disclosed that includes the step of bending an edge of a floorboard during the assembling. The bending reduces the force required for connection of the edge to another edge of a juxtaposed floorboard. The floorboards may be provided with a mechanical locking system for vertical and horizontal locking of two adjacent floorboards.

19 Claims, 9 Drawing Sheets

Related U.S. Application Data

Jan. 4, 2013, now Pat. No. 8,756,899, which is a continuation of application No. 12/875,293, filed on Sep. 3, 2010, now Pat. No. 8,365,499.

(60) Provisional application No. 61/239,927, filed on Sep. 4, 2009.

(56) References Cited

U.S. PATENT DOCUMENTS 3,120,083 A 2/1964 Dahlberg et al.
3,247,638 A 4/1966 Gay et al.
3,538,665 A 11/1970 Gohner
3,619,961 A 11/1971 Sterrett et al.
3,694,983 A 10/1972 Couquet
3,720,027 A 3/1973 Christensen
3,742,669 A 7/1973 Mansfeld
3,760,547 A 9/1973 Brenneman
3,857,749 A 12/1974 Yoshida
3,919,820 A 11/1975 Green
4,113,399 A 9/1978 Hansen, Sr. et al.
4,172,169 A 10/1979 Mawson et al.
4,176,210 A 11/1979 Skinner
4,180,615 A 12/1979 Bettoli
4,187,131 A 2/1980 Shortway et al.
4,196,554 A 4/1980 Anderson et al.
4,313,866 A 2/1982 Renshaw
4,333,987 A 6/1982 Kwart et al.
4,393,187 A 7/1983 Boba et al.
4,423,178 A 12/1983 Renshaw
4,426,820 A 1/1984 Terbrack et al.
4,489,115 A 12/1984 Layman et al.
4,507,188 A 3/1985 Chu
4,512,131 A 4/1985 Laramore
4,599,841 A 7/1986 Haid
4,614,680 A 9/1986 Fry et al.
4,772,500 A 9/1988 Stroppiana
4,785,065 A 11/1988 Uhl et al.
4,807,412 A * 2/1989 Frederiksen ..... A47G 27/0212 52/177
5,007,222 A 4/1991 Raymond
5,112,671 A 5/1992 Diamond et al.
5,148,850 A 9/1992 Urbanick
5,162,141 A 11/1992 Davey et al.
5,182,892 A 2/1993 Chase
5,274,979 A 1/1994 Tsai
5,344,700 A 9/1994 McGath et al.
5,380,794 A 1/1995 Schaefer et al.
5,441,677 A 8/1995 Phillips, Sr.
5,458,953 A 10/1995 Wang et al.
5,465,546 A 11/1995 Buse
5,548,937 A 8/1996 Shimonohara
5,618,602 A 4/1997 Nelson
5,630,304 A 5/1997 Austin
5,670,237 A 9/1997 Shultz et al.
5,694,730 A 12/1997 Del Rincon et al.
5,797,237 A * 8/1998 Finkell, Jr. ..... E04F 15/04 52/586.1
5,950,389 A 9/1999 Porter
6,006,486 A 12/1999 Moriau et al.
6,052,960 A 4/2000 Yonemura
6,065,262 A 5/2000 Motta
6,101,778 A 8/2000 Martensson
6,139,945 A 10/2000 Krejchi et al.
6,173,548 B1 1/2001 Hamar et al.
6,182,410 B1 2/2001 Pervan
6,209,278 B1 4/2001 Tychsen
6,216,409 B1 4/2001 Roy et al.
6,233,899 B1 5/2001 Mellert et al.
6,291,078 B1 9/2001 Chen et al.
6,324,809 B1 12/2001 Nelson
6,332,733 B1 12/2001 Hamberger et al.
6,345,481 B1 2/2002 Nelson
6,363,677 B1 4/2002 Chen
6,455,127 B1 9/2002 Valtanen
6,490,836 B1 12/2002 Moriau et al.
6,505,452 B1 1/2003 Hannig
6,536,178 B1 3/2003 Palsson et al.
6,546,691 B2 4/2003 Leopolder
6,553,724 B1 4/2003 Bigler
6,558,070 B1 5/2003 Valtanen
6,617,009 B1 9/2003 Chen et al.
6,647,690 B1 11/2003 Martensson
6,672,030 B2 * 1/2004 Schulte ..... E04F 15/02 52/539
6,675,545 B2 1/2004 Chen et al.
6,715,253 B2 4/2004 Pervan
6,729,091 B1 5/2004 Martensson
6,761,008 B2 7/2004 Chen et al.
6,763,643 B1 7/2004 Martensson
6,766,622 B1 7/2004 Theirs
6,769,218 B2 * 8/2004 Pervan ..... E04F 15/04 52/591.1
6,769,219 B2 8/2004 Schwitte et al.
6,772,568 B2 8/2004 Thiers
6,790,512 B2 9/2004 MacQueen et al.
6,804,926 B1 10/2004 Eisermann
6,851,241 B2 2/2005 Pervan
6,854,235 B2 2/2005 Martensson
6,862,857 B2 3/2005 Tychsen
6,865,855 B2 3/2005 Knauseder
6,874,292 B2 4/2005 Moriau
6,880,307 B2 4/2005 Schwitte
6,895,881 B1 5/2005 Whitaker
6,918,220 B2 7/2005 Pervan
6,928,779 B2 8/2005 Moriau et al.
6,986,934 B2 1/2006 Chen et al.
7,051,486 B2 5/2006 Pervan
7,090,430 B1 8/2006 Fletcher
7,121,058 B2 10/2006 Palsson et al.
7,127,860 B2 10/2006 Pervan et al.
7,155,871 B1 1/2007 Stone et al.
7,169,460 B1 1/2007 Chen et al.
7,171,791 B2 * 2/2007 Pervan ..... E04F 15/04 52/589.1
7,211,310 B2 5/2007 Chen et al.
7,251,916 B2 8/2007 Konzelmann et al.
7,275,350 B2 10/2007 Pervan et al.
7,337,588 B1 3/2008 Moebus
7,377,081 B2 5/2008 Ruhdorfer
7,398,625 B2 7/2008 Pervan
7,419,717 B2 9/2008 Chen et al.
7,451,578 B2 11/2008 Ig
7,454,875 B2 11/2008 Pervan et al.
7,484,337 B2 2/2009 Hecht
7,552,568 B2 6/2009 Palsson et al.
7,568,322 B2 8/2009 Pervan et al.
7,584,583 B2 9/2009 Bergelin et al.
7,603,826 B1 10/2009 Moebus
7,607,271 B2 10/2009 Griffin et al.
7,614,197 B2 11/2009 Nelson
7,617,645 B2 11/2009 Moriau et al.
7,617,651 B2 11/2009 Grafenauer
7,621,094 B2 11/2009 Moriau et al.
7,634,886 B2 12/2009 Moriau et al.
7,634,887 B2 12/2009 Moriau et al.
7,637,066 B2 12/2009 Moriau et al.
7,640,708 B2 1/2010 Moriau et al.
7,644,555 B2 1/2010 Moriau et al.
7,644,557 B2 1/2010 Moriau et al.
7,647,743 B2 1/2010 Moriau et al.
7,650,728 B2 1/2010 Moriau et al.
7,654,054 B2 2/2010 Moriau et al.
7,658,048 B2 2/2010 Moriau et al.
7,677,001 B2 3/2010 Pervan
7,678,215 B2 3/2010 Martin
7,716,896 B2 5/2010 Pervan
7,739,849 B2 * 6/2010 Pervan ..... E04F 15/02 52/582.1
7,763,345 B2 7/2010 Chen et al.
7,779,597 B2 * 8/2010 Thiers ..... E04F 15/10 52/588.1
7,802,415 B2 9/2010 Pervan
7,841,144 B2 11/2010 Pervan

(56) References Cited

U.S. PATENT DOCUMENTS 7,841,150 B2 11/2010 Pervan
7,856,784 B2 12/2010 Martensson
7,856,789 B2 * 12/2010 Eisermann ..... B27F 1/04 52/747.1
7,861,482 B2 1/2011 Pervan
7,866,110 B2 1/2011 Pervan
7,874,118 B2 1/2011 Schitter
7,886,497 B2 2/2011 Pervan et al.
7,896,571 B1 3/2011 Hannig et al.
7,908,816 B2 3/2011 Grafenauer
7,930,862 B2 4/2011 Bergelin et al.
7,958,689 B2 6/2011 Lei
7,980,043 B2 7/2011 Moebus
7,984,600 B2 7/2011 Alford et al.
8,006,460 B2 8/2011 Chen et al.
8,021,741 B2 9/2011 Chen et al.
8,028,486 B2 10/2011 Pervan
8,033,074 B2 10/2011 Pervan et al.
8,037,656 B2 10/2011 Liu
8,038,363 B2 10/2011 Hannig
8,042,311 B2 10/2011 Pervan et al.
8,071,193 B2 12/2011 Windmöller
8,091,238 B2 1/2012 Hannig et al.
8,099,924 B2 1/2012 Braun
8,112,891 B2 2/2012 Pervan
8,132,384 B2 3/2012 Hannig
8,166,718 B2 5/2012 Liu
8,191,333 B2 6/2012 Braun
8,196,366 B2 6/2012 Thiers
8,215,078 B2 7/2012 Pervan
8,234,829 B2 8/2012 Thiers et al.
8,245,478 B2 8/2012 Bergelin et al.
8,281,549 B2 10/2012 Du
8,293,058 B2 10/2012 Pervan et al.
8,302,361 B2 11/2012 Braun et al.
8,353,140 B2 1/2013 Pervan et al.
8,356,452 B2 1/2013 Thiers et al.
8,365,499 B2 2/2013 Nilsson et al.
8,375,672 B2 2/2013 Hannig
8,375,674 B2 2/2013 Braun
8,480,841 B2 7/2013 Pervan et al.
8,484,924 B2 7/2013 Braun
8,490,361 B2 7/2013 Curry et al.
8,499,521 B2 8/2013 Pervan et al.
8,511,031 B2 8/2013 Bergelin et al.
8,511,040 B2 8/2013 Braun et al.
8,544,231 B2 10/2013 Hannig
8,544,232 B2 10/2013 Wybo et al.
8,544,234 B2 10/2013 Pervan et al.
8,584,423 B2 11/2013 Pervan et al.
8,613,826 B2 12/2013 Pervan et al.
8,658,274 B2 2/2014 Chen et al.
8,689,512 B2 4/2014 Pervan
8,707,651 B2 4/2014 Stockl
8,720,149 B2 5/2014 Bossuyt
8,726,604 B2 5/2014 Hannig
8,745,952 B2 6/2014 Perra et al.
8,756,899 B2 6/2014 Nilsson et al.
8,763,340 B2 7/2014 Pervan et al.
8,800,150 B2 8/2014 Pervan
8,806,832 B2 8/2014 Kell
8,833,028 B2 9/2014 Whispell et al.
8,834,992 B2 9/2014 Chen et al.
8,952,078 B2 2/2015 Gould
8,966,853 B2 3/2015 Hannig
8,978,336 B2 3/2015 Perra
9,103,126 B2 8/2015 Kell
9,212,492 B2 12/2015 Pervan et al.
9,217,250 B2 12/2015 Perra
9,222,267 B2 12/2015 Bergelin et al.
9,228,360 B2 1/2016 Schneider
9,249,581 B2 2/2016 Nilsson et al.
9,260,870 B2 2/2016 Vermeulen et al.
9,296,191 B2 3/2016 Pervan et al.
9,314,936 B2 4/2016 Pervan
9,371,653 B2 6/2016 Liu
9,410,328 B2 8/2016 Pervan
9,528,278 B2 12/2016 Cappelle
9,650,792 B2 5/2017 Ramachandra
9,695,600 B2 7/2017 Vandervoorde
9,695,601 B2 7/2017 Whispell et al.
9,695,851 B2 7/2017 Hanning
9,714,515 B2 7/2017 Pervan
9,745,758 B2 8/2017 Baert et al.
9,765,530 B2 9/2017 Bergelin et al.
9,777,487 B2 10/2017 Pervan et al.
9,803,374 B2 10/2017 Pervan
9,816,270 B2 11/2017 Pervan et al.
9,856,657 B2 1/2018 Thiers
9,874,035 B2 1/2018 Wagner
9,885,186 B2 2/2018 Liu
9,885,187 B2 2/2018 Kell
10,000,935 B2 6/2018 Kell
10,047,527 B2 8/2018 Nilsson et al.
10,059,084 B2 8/2018 Lundblad et al.
10,113,318 B2 10/2018 Cappelle
10,137,659 B2 11/2018 Pervan
10,214,917 B2 2/2019 Pervan et al.
10,287,777 B2 5/2019 Boo et al.
10,301,830 B2 5/2019 Boo
10,316,526 B2 6/2019 Kell
10,344,379 B2 7/2019 Pervan
10,407,919 B2 9/2019 Boo
10,450,760 B2 10/2019 Bergelin et al.
10,486,399 B2 11/2019 Chen et al.
10,493,731 B2 12/2019 Lundblad et al.
10,526,793 B2 1/2020 Nilsson et al.
10,704,269 B2 7/2020 Whispell et al.
10,780,676 B2 9/2020 Lundblad et al.
10,808,410 B2 10/2020 Boo et al.
10,837,181 B2 11/2020 Josefsson et al.
10,844,612 B2 11/2020 Boo
10,851,549 B2 12/2020 Boo
10,865,571 B2 12/2020 Kell
10,975,580 B2 4/2021 Pervan et al.
10,982,449 B2 4/2021 Kell
11,066,836 B2 7/2021 Bergelin et al.
2001/0021431 A1 9/2001 Chen
2002/0007606 A1 1/2002 Kettler
2002/0007608 A1 1/2002 Pervan
2002/0007609 A1 1/2002 Pervan
2002/0031646 A1 3/2002 Chen
2002/0069611 A1 6/2002 Leopolder
2002/0092263 A1 7/2002 Schulte
2002/0112433 A1 8/2002 Pervan
2002/0142135 A1 10/2002 Chen et al.
2002/0152707 A1 10/2002 Martensson
2002/0170258 A1 11/2002 Schwitte et al.
2002/0178674 A1 12/2002 Pervan
2002/0178681 A1 12/2002 Zancai
2002/0189183 A1 12/2002 Ricciardelli
2003/0009971 A1 1/2003 Palmberg
2003/0024199 A1 2/2003 Pervan
2003/0024200 A1 2/2003 Moriau et al.
2003/0037504 A1 2/2003 Schwitte et al.
2003/0041545 A1 3/2003 Stanchfield
2003/0084636 A1 5/2003 Pervan
2003/0101674 A1 6/2003 Pervan et al.
2003/0101681 A1 6/2003 Tychsen
2003/0110720 A1 6/2003 Berard et al.
2003/0180091 A1 9/2003 Stridsman
2003/0188504 A1 10/2003 Eisermann
2003/0196405 A1 10/2003 Pervan
2003/0224147 A1 12/2003 Maine et al.
2004/0031225 A1 2/2004 Fowler
2004/0031227 A1 2/2004 Knauseder
2004/0060255 A1 4/2004 Knauseder
2004/0068954 A1 4/2004 Martensson
2004/0128934 A1 7/2004 Hecht
2004/0137180 A1 7/2004 Sjoberg et al.
2004/0139678 A1 7/2004 Pervan
2004/0177584 A1 9/2004 Pervan
2004/0182036 A1 9/2004 Sjoberg et al.
2004/0206036 A1 10/2004 Pervan

(56) References Cited

U.S. PATENT DOCUMENTS

2004/0211143 A1 10/2004 Hannig
2004/0211144 A1 10/2004 Stanchfield
2004/0219339 A1 11/2004 Dempsey et al.
2004/0241374 A1 12/2004 Thiers
2004/0250492 A1 12/2004 Becker
2004/0255538 A1 12/2004 Ruhdorfer
2004/0255541 A1 12/2004 Thiers et al.
2004/0261348 A1 12/2004 Vulin
2005/0003160 A1 1/2005 Chen et al.
2005/0028474 A1 2/2005 Kim
2005/0112320 A1 5/2005 Wright
2005/0138881 A1 6/2005 Pervan
2005/0144881 A1 7/2005 Tate et al.
2005/0166514 A1 8/2005 Pervan
2005/0176321 A1 8/2005 Crette et al.
2005/0021081 A1 9/2005 Pervan
2005/0193677 A1 9/2005 Vogel
2005/0208255 A1 9/2005 Pervan
2005/0221073 A1 10/2005 Liou
2005/0235593 A1 10/2005 Hecht
2005/0247000 A1 11/2005 Zhu
2005/0250921 A1 11/2005 Qiu et al.
2005/0252130 A1 11/2005 Martensson
2005/0268570 A2 12/2005 Pervan
2006/0010820 A1 1/2006 Schwitte
2006/0032168 A1 2/2006 Thiers et al.
2006/0032175 A1 2/2006 Chen et al.
2006/0053724 A1 3/2006 Braun et al.
2006/0070333 A1 4/2006 Pervan
2006/0101769 A1 5/2006 Pervan et al.
2006/0154015 A1 7/2006 Miller et al.
2006/0156666 A1 7/2006 Caufield
2006/0174974 A1 8/2006 Brannstrom et al.
2006/0225377 A1 10/2006 Moriau et al.
2006/0236642 A1 10/2006 Pervan
2006/0248830 A1 11/2006 Moriau et al.
2006/0248831 A1 11/2006 Moriau et al.
2006/0260252 A1 11/2006 Brice
2006/0260254 A1 11/2006 Pervan
2007/0006543 A1 1/2007 Engstrom
2007/0011981 A1 1/2007 Eiserman
2007/0022694 A1 2/2007 Chen et al.
2007/0028547 A1 2/2007 Grafenauer et al.
2007/0094986 A1 5/2007 Moriau et al.
2007/0094987 A1 5/2007 Moriau et al.
2007/0130872 A1 6/2007 Goodwin
2007/0151189 A1 7/2007 Yang
2007/0151191 A1 7/2007 August
2007/0154840 A1 7/2007 Thies et al.
2007/0175148 A1 8/2007 Bergelin et al.
2007/0175156 A1 8/2007 Pervan et al.
2007/0184230 A1 8/2007 Verrue et al.
2007/0193178 A1 8/2007 Groeke et al.
2007/0196624 A1 8/2007 Chen et al.
2007/0218252 A1 9/2007 Donald
2007/0275207 A1 11/2007 Higgins et al.
2008/0000182 A1 1/2008 Pervan
2008/0000183 A1 1/2008 Bergelin et al.
2008/0000186 A1 1/2008 Pervan et al.
2008/0000188 A1 1/2008 Pervan
2008/0010931 A1 1/2008 Pervan et al.
2008/0010937 A1 1/2008 Pervan
2008/0028707 A1 2/2008 Pervan
2008/0028713 A1 2/2008 Pervan
2008/0029490 A1* 2/2008 Martin, Jr. ..... B29C 66/1142
219/117.1
2008/0034701 A1 2/2008 Pervan
2008/0034708 A1 2/2008 Pervan
2008/0041007 A1 2/2008 Pervan
2008/0053028 A1 3/2008 Moriau et al.
2008/0060309 A1 3/2008 Moriau et al.
2008/0060310 A1 3/2008 Moriau et al.
2008/0092473 A1 4/2008 Heyns
2008/0104921 A1 5/2008 Pervan et al.
2008/0110125 A1 5/2008 Pervan
2008/0014161 A1 6/2008 Thiers
2008/0134607 A1 6/2008 Pervan
2008/0134613 A1 6/2008 Pervan
2008/0134614 A1 6/2008 Pervan
2008/0138560 A1 6/2008 Windmöller
2008/0148674 A1 6/2008 Thiers et al.
2008/0153609 A1 6/2008 Kotler
2008/0172971 A1 7/2008 Pervan
2008/0184646 A1 8/2008 Alford
2008/0241440 A1 10/2008 Bauer
2008/0256890 A1 10/2008 Pervan
2008/0311355 A1 12/2008 Chen et al.
2009/0019808 A1 1/2009 Palsson et al.
2009/0031662 A1 2/2009 Chen et al.
2009/0038253 A1 2/2009 Martensson
2009/0049787 A1 2/2009 Hannig
2009/0110888 A1 4/2009 Wuest et al.
2009/0133353 A1* 5/2009 Pervan ..... E04F 15/107
52/588.1
2009/0151290 A1 6/2009 Liu
2009/0159156 A1 6/2009 Walker
2009/0186710 A1 7/2009 Joseph
2009/0193748 A1 8/2009 Boo
2009/0193753 A1 8/2009 Schitter
2009/0217611 A1 9/2009 Schrader
2009/0223162 A1 9/2009 Chen et al.
2009/0226662 A1 9/2009 Dyczko-Riglin et al.
2009/0235604 A1 9/2009 Cheng et al.
2009/0249733 A1 10/2009 Moebus
2009/0260313 A1 10/2009 Segaert
2009/0272058 A1 11/2009 Duselis et al.
2009/0320402 A1 12/2009 Schacht et al.
2010/0011695 A1 1/2010 Cheng
2010/0018149 A1 1/2010 Thiers
2010/0031594 A1 2/2010 Liu
2010/0043333 A1 2/2010 Hannig et al.
2010/0058702 A1 3/2010 Lei
2010/0260962 A1 10/2010 Chen et al.
2010/0293879 A1 11/2010 Pervan et al.
2010/0300029 A1 12/2010 Braun et al.
2010/0319293 A1 12/2010 Dammers et al.
2011/0001420 A1 1/2011 Tchakarov et al.
2011/0008567 A1 1/2011 Weeks et al.
2011/0030303 A1 2/2011 Pervan et al.
2011/0041996 A1 2/2011 Pervan
2011/0056167 A1 3/2011 Nilsson et al.
2011/0094178 A1 4/2011 Braun
2011/0131901 A1 6/2011 Pervan et al.
2011/0131909 A1 6/2011 Hannig
2011/0138722 A1 6/2011 Hannig
2011/0146177 A1 6/2011 Hannig
2011/0154763 A1 6/2011 Bergelin et al.
2011/0167744 A1 7/2011 Whispell et al.
2011/0167751 A1 7/2011 Engstrom
2011/0173914 A1 7/2011 Engstrom
2011/0247285 A1 10/2011 Wybo
2011/0247748 A1 10/2011 Pervan et al.
2011/0258959 A1 10/2011 Braun
2011/0296780 A1 12/2011 Windmöller
2012/0003439 A1 1/2012 Chen et al.
2012/0040149 A1 2/2012 Chen et al.
2012/0067461 A1 3/2012 Braun
2012/0137617 A1 6/2012 Pervan
2012/0180416 A1 7/2012 Perra et al.
2012/0216472 A1 8/2012 Martensson
2012/0266555 A1 10/2012 Cappelle
2012/0276369 A1 11/2012 Jing et al.
2012/0279154 A1 11/2012 Bergelin et al.
2013/0014890 A1 1/2013 Pervan et al.
2013/0047536 A1 2/2013 Pervan
2013/0111758 A1 5/2013 Nilsson et al.
2013/0160391 A1 6/2013 Pervan et al.
2013/0269863 A1 10/2013 Pervan et al.
2013/0298487 A1 11/2013 Bergelin et al.
2013/0333182 A1 12/2013 Pervan et al.
2014/0007539 A1 1/2014 Pervan et al.
2014/0033633 A1 2/2014 Kell
2014/0033635 A1 2/2014 Pervan et al.
2014/0069043 A1 3/2014 Pervan

(56) References Cited

U.S. PATENT DOCUMENTS

| | | | |
|---|---|---|---|
| 2014/0069044 | A1 | 3/2014 | Wallin |
| 2014/0115994 | A1 | 5/2014 | Pervan |
| 2014/0237924 | A1 | 8/2014 | Nilsson et al. |
| 2014/0283466 | A1 | 9/2014 | Boo |
| 2014/0318061 | A1 | 10/2014 | Pervan |
| 2014/0352248 | A1 | 12/2014 | Whispell et al. |
| 2014/0356594 | A1 | 12/2014 | Chen et al. |
| 2014/0366476 | A1 | 12/2014 | Pervan |
| 2014/0366477 | A1 | 12/2014 | Kell |
| 2015/0225964 | A1 | 8/2015 | Chen et al. |
| 2015/0368910 | A1 | 12/2015 | Kell |
| 2016/0016390 | A1 | 1/2016 | Lundblad et al. |
| 2016/0016391 | A1 | 1/2016 | Lundblad et al. |
| 2016/0052245 | A1 | 2/2016 | Chen et al. |
| 2016/0069089 | A1 | 3/2016 | Bergelin et al. |
| 2016/0076260 | A1 | 3/2016 | Pervan et al. |
| 2016/0108624 | A1 | 4/2016 | Nilsson et al. |
| 2016/0186318 | A1 | 6/2016 | Pervan et al. |
| 2016/0194883 | A1 | 7/2016 | Pervan |
| 2016/0194885 | A1 | 7/2016 | Whispell et al. |
| 2016/0201324 | A1 | 7/2016 | Håkansson et al. |
| 2016/0265234 | A1 | 9/2016 | Pervan |
| 2017/0037642 | A1 | 2/2017 | Boo |
| 2017/0037645 | A1 | 2/2017 | Pervan |
| 2017/0175400 | A1 | 6/2017 | Joseffson et al. |
| 2017/0241136 | A1 | 8/2017 | Kell |
| 2017/0350140 | A1 | 12/2017 | Bergelin et al. |
| 2017/0362834 | A1 | 12/2017 | Pervan et al. |
| 2018/0094441 | A1 | 4/2018 | Boo et al. |
| 2018/0313093 | A1 | 11/2018 | Nilsson et al. |
| 2019/0017278 | A1 | 1/2019 | De Rick et al. |
| 2019/0091977 | A1 | 3/2019 | Lundblad et al. |
| 2019/0211569 | A1 | 7/2019 | Boo et al. |
| 2019/0249444 | A1 | 8/2019 | Kell |
| 2019/0277041 | A1 | 9/2019 | Pervan et al. |
| 2019/0394314 | A1 | 12/2019 | Pervan et al. |
| 2020/0056379 | A1 | 2/2020 | Boo |
| 2020/0063441 | A1 | 2/2020 | Boo |
| 2020/0180282 | A1 | 6/2020 | Lundblad et al. |
| 2020/0208409 | A1 | 7/2020 | Kell |
| 2020/0248462 | A1 | 8/2020 | Bergelin et al. |
| 2020/0407981 | A1 | 12/2020 | Boo et al. |
| 2021/0053322 | A1 | 2/2021 | Lundblad et al. |
| 2021/0115680 | A1 | 4/2021 | Whispell et al. |
| 2021/0207385 | A1 | 7/2021 | Boo |
| 2021/0214953 | A1 | 7/2021 | Kell |
| 2021/0230881 | A1 | 7/2021 | Boo |

FOREIGN PATENT DOCUMENTS

| | | | |
|---|---|---|---|
| DE | 202 07 844 | U | 8/2002 |
| DE | 20 2005 004 537 | U1 | 6/2005 |
| DE | 10 2004 001 363 | A1 | 8/2005 |
| DE | 198 54 475 | B4 | 6/2006 |
| DE | 10 2005 024 366 | A1 | 11/2006 |
| DE | 10 2005 061 099 | A1 | 3/2007 |
| DE | 10 2006 024 184 | A1 | 11/2007 |
| DE | 20 2008 011 589 | U1 | 11/2008 |
| DE | 20 2008 012 001 | U1 | 11/2008 |
| DE | 20 2016 102 034 | U1 | 5/2016 |
| EP | 1 045 083 | A1 | 10/2000 |
| EP | 1 045 083 | B1 | 10/2002 |
| EP | 1 350 904 | A2 | 10/2003 |
| EP | 1 350 904 | A3 | 10/2003 |
| EP | 1 396 593 | A2 | 3/2004 |
| EP | 1 420 125 | A2 | 5/2004 |
| EP | 1 437 457 | A2 | 7/2004 |
| EP | 1 437 457 | A3 | 7/2004 |
| EP | 1 585 875 | | 10/2005 |
| EP | 1 640 530 | A2 | 3/2006 |
| EP | 1 585 875 | B1 | 10/2006 |
| EP | 1 570 143 | | 5/2007 |
| ER | 1 308 577 | A2 | 5/2003 |
| FR | 1 293 043 | | 4/1962 |
| GB | 1 430 423 | A | 3/1976 |
| JP | S60-255843 | A | 12/1985 |
| JP | H07-180333 | A | 7/1995 |
| JP | H07-300979 | | 11/1995 |
| JP | H08-74405 | A | 3/1996 |
| KR | 1996-0005785 | | 7/1996 |
| KR | 10-2008-0096189 | | 10/2008 |
| KR | 10-0870496 | | 11/2008 |
| WO | WO 94/26999 | A1 | 11/1994 |
| WO | WO 00/20705 | A1 | 4/2000 |
| WO | WO 00/66856 | A1 | 11/2000 |
| WO | WO 01/44669 | A2 | 6/2001 |
| WO | WO 01/44669 | A3 | 6/2001 |
| WO | WO 01/48332 | A1 | 7/2001 |
| WO | WO 01/53628 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/88306 | A1 | 11/2001 |
| WO | WO 03/012224 | A1 | 2/2003 |
| WO | WO 03/025307 | A1 | 3/2003 |
| WO | WO 03/089736 | A1 | 10/2003 |
| WO | WO 2004/011740 | A2 | 2/2004 |
| WO | WO 2004/016876 | A2 | 2/2004 |
| WO | WO 2004/016877 | A1 | 2/2004 |
| WO | WO 2004/085765 | A1 | 10/2004 |
| WO | WO 2005/068747 | A1 | 7/2005 |
| WO | WO 2005/088029 | A1 | 9/2005 |
| WO | WO 2005/098163 | A1 | 10/2005 |
| WO | WO 2006/032378 | A1 | 3/2006 |
| WO | WO 2006/043893 | A1 | 4/2006 |
| WO | WO 2006/104436 | A1 | 10/2006 |
| WO | WO 2006/123988 | A1 | 11/2006 |
| WO | WO 2006/133690 | A1 | 12/2006 |
| WO | WO 2007/015669 | A2 | 2/2007 |
| WO | WO 2007/015669 | A3 | 2/2007 |
| WO | WO 2007/016978 | A1 | 2/2007 |
| WO | WO 2007/020088 | A1 | 2/2007 |
| WO | WO 2007/079845 | A1 | 7/2007 |
| WO | WO 2007/118352 | A1 | 10/2007 |
| WO | WO 2008/008016 | A1 | 1/2008 |
| WO | WO 2008/008824 | A1 | 1/2008 |
| WO | WO 2008/068245 | A1 | 6/2008 |
| WO | WO 2008/116623 | A1 | 10/2008 |
| WO | WO 2008/133377 | A1 | 11/2008 |
| WO | WO 2009/033623 | A1 | 3/2009 |
| WO | WO 2009/061279 | A1 | 5/2009 |
| WO | WO 2009/071822 | A2 | 6/2009 |
| WO | WO 2009/071822 | A3 | 6/2009 |
| WO | WO 2010/015516 | A2 | 2/2010 |
| WO | WO 2010/015516 | A3 | 2/2010 |
| WO | WO 2010/072357 | A2 | 7/2010 |
| WO | WO 2010/072357 | A3 | 7/2010 |
| WO | WO 2010/081532 | A1 | 7/2010 |
| WO | WO 2010/086084 | A1 | 8/2010 |

OTHER PUBLICATIONS

U.S. Appl. No. 17/017,085, **Boo et al.—See Information Below.
U.S. Appl. No. 17/067,989, **Boo—See Information Below.
U.S. Appl. No. 17/076,445, **Boo—See Information Below.
International Search Report issued in PCT/SE2010/050941, dated Nov. 1, 2010, Patent-och registreringsverket, Stockholm, SE, 5 pages.
Extended European Search Report issued in EP 10814032.8, dated Aug. 2, 2017, European Patent Office, Munich, DE, 9 pages.
Extended European Search Report issued in EP 19168204.6, dated Aug. 1, 2019, European Patent Office, Munich, DE, 9 pages.
Pervan, Darko (Author)/Valinge Innovation, Technical Disclosure entitled "VA073a Zip Loc," Sep. 13, 2011, IP.com No. IPCOM000210869D, IP.com PriorArtDatabase, 36 pages.
Communication Pursuant to Article 94(3) EPC dated Oct. 13, 2017 in EP Patent Application No. 14 794 996.0, EPO, Munich, DE, 9 pages.
Complaint, *Välinge Innovation AB* v. *Halstead New England Corp. and The Home Depot, Inc.*, United States District Court for the District of Delaware, Case No. 1-16-cv-01082, dated Nov. 23, 2016, 14 pages.

(56) References Cited

OTHER PUBLICATIONS

Second Amended Complaint, *Välinge Innovation AB* v. *Halstead New England Corp., Halstead International; Home Depot U.S.A., Inc.; and The Home Depot, Inc.*, United States District Court for the District of Delaware, Case No. 16-1082-LPS-CJB, dated Mar. 28, 2017, 55 pages.
Plaintiff's Opening Claim Construction Brief, *Välinge Innovation AB* v. *Halstead New England Corp. and Home Depot U.S.A., Inc.*, United States District Court forthe District of Delaware, C.A. No. 16-1082-LPS-CJB, dated Dec. 11, 2017, 38 pages (Document 86).
Declaration of Pilar G. Kraman in Support of Plaintiff's Opening Claim Construction Brief, with Exhibits 1-6, *Välinge Innovation AB* v. *Halstead New England Corp. and Home Depot U.S.A., Inc.*, United States District Court for the District of Delaware, C.A. No. 16-1082-LPS-CJB, dated Dec. 11, 2017, 65 pages (Document 87, 87-1).
Declaration of Steven B. MacLean in Support of Plaintiff's Opening Claim Construction Brief, with Exhibits 1-2, *Välinge Innovation AB* v. *Halstead New England Corp. and Home Depot U.S.A., Inc.*, United States District Court for the District of Delaware, C.A. No. 16-1082-LPS-CJB, dated Dec. 11, 2017, 23 pages (Document 88, 88-1, 88-2).
Defendants Halstead New England Corp. and Home Depot U.S.A., Inc.'s Opening Claim Construction Brief, *Välinge Innovation AB* v. *Halstead New England Corp. and Home Depot U.S.A., Inc.*, United States District Court for the District of Delaware, C.A. No. 16-1082-LPS-CJB, dated Dec. 11, 2017, 36 pages (Document 89).
Declaration of Robert M Kimmel, Sc.D. on Claim Construction, with Exhibits A-Q, *Välinge Innovation AB* v. *Halstead New England Corp. and Home Depot U.S.A., Inc.*, United States District Court for the District of Delaware, C.A. No. 16-1082-LPS-CJB, dated Dec. 11, 2017, 153 pages (Document 90, 90-1, 90-2).
Declaration of Richard T. Kaczkowski, with Exhibits A-D, *Välinge Innovation AB* v. *Halstead New England Corp. and Home Depot U.S.A., Inc.*, United States District Court for the District of Delaware, C.A. No. 16-1082-LPS-CJB, dated Dec. 11, 2017, 48 pages (Document 91, 91-1).
Exhibits 1-17 (re Document 89), *Välinge Innovation AB* v. *Halstead New England Corp. and Home Depot U.S.A., Inc.*, United States District Court for the District of Delaware, C.A. No. 16-1082-LPS-CJB, dated Dec. 11, 2017, 381 pages (Document 92, 92-1).
Plaintiff's Responsive Claim Construction Brief, *Välinge Innovation AB* v. *Halstead New England Corp. and Home Depot U.S.A., Inc.*, United States District Court for the District of Delaware, C.A. No. 16-1082-LPS-CJB, dated Jan. 16, 2018, 29 pages (Document 98).
Declaration of Pilar G. Kraman in Support of Plaintiff's Responsive Claim Construction Brief, with Exhibits 1-15, *Välinge Innovation AB* v. *Halstead New England Corp. and Home Depot U.S.A., Inc.*, United States District Court for the District of Delaware, C.A. No. 16-1082-LPS-CJB, dated Jan. 16, 2018, 105 pages (Document 99, 99-1).
Declaration of Steven B. MacLean in Support of Plaintiff's Responsive Claim Construction Brief, *Välinge Innovation AB* v. *Halstead New England Corp. and Home Depot U.S.A., Inc.*, United States District Court for the District of Delaware, C.A. No. 16-1082-LPS-CJB, dated Jan. 16, 2018, 25 pages (Document 100).
Defendants Halstead New England Corp. and Home Depot U.S.A., Inc.'s Responsive Claim Construction Brief, *Välinge Innovation AB* v. *Halstead New England Corp. and Home Depot U.S.A., Inc.*, United States District Court for the District of Delaware, C.A. No. 16-1082-LPS-CJB, dated Jan. 16, 2018, 26 pages (Document 102, 102-1).
Declaration of Brian A. Biggs in Support of Defendants Halstead New England Corp. and Home Depot U.S.A., Inc.'s Responsive Claim Construction Brief, with Exhibit 1, *Välinge Innovation AB* v. *Halstead New England Corp. and Home Depot U.S.A., Inc.*, United States District Court for the District of Delaware, C.A. No. 16-1082-LPS-CJB, dated Jan. 16, 2018, 6 pages (Document 103, 103-1, 103-2).
Supplemental Declaration of Robert M. Kimmel, Sc.D. on Claim Construction, with Exhibits A-J, *Välinge Innovation AB* v. *Halstead New England Corp. and Home Depot U.S.A., Inc.*, United States District Court for the District of Delaware, C.A. No. 16-1082-LPS-CJB, dated Jan. 16, 2018, 69 pages (Document 104, 104-1, 104-2).
Memorandum Opinion, *Välinge Innovation AB* v. *Halstead New England Corp. and Home Depot U.S.A., Inc.*, United States District Court for the District of Delaware, C.A. No. 16-1082-LPS-CJB, dated May 7, 2018, 19 pages (Document 162).
Order, *Välinge Innovation AB* v. *Halstead New England Corp. and Home Depot U.S.A., Inc.*, United States District Court for the District of Delaware, C.A. No. 16-1082-LPS-CJB, dated May 7, 2018, 2 pages (Document 163).
Third Amended Complaint, *Välinge Innovation AB* v. *Halstead New England Corp. and Home Depot U.S.A., Inc.*, United States District Court for the District of Delaware, C.A. No. 16-1082-LPS-CJB, dated Jul. 10, 2018, 69 pages (Document 214).
Defendant Halstead New England Corp.'s Answer to the Third Amended Complaint, Affirmative Defenses and Counterclaim—*Välinge Innovation AB* v. *Halstead New England Corp. and Home Depot U.S.A., Inc.*, United States District Court for the District of Delaware, C.A. No. 16-1082-LPS-CJB, dated Aug. 8, 2018, 172 pages (Document 242, 242-1, 242-2, 242-3—Redacted Version of Document 230).
Joint Motion for Entry of Partial Summary Judgment—*Välinge Innovation AB* v. *Halstead New England Corp. and Home Depot U.S.A., Inc.*, United States District Court for the District of Delaware, C.A. No. 16-1082-LPS-CJB, dated Sep. 13, 2018, 4 pages (Document 262).
Order of Partial Summary Judgment—*Välinge Innovation AB* v. *Halstead New England Corp. and Home Depot U.S.A., Inc.*, United States District Court for the District of Delaware, C.A. No. 16-1082-LPS-CJB, dated Sep. 13, 2018, 2 pages (Document 262-1).
Välinge Innovation AB, Technical Disclosure entitled "Mechanical locking for floor panels with Vertical Folding," IP.com No. IPCOM000179246D, Feb. 10, 2009, IP.com PriorArtDatabase, 59 pp.
Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.
Whispell, John M., et al., U.S. Appl. No. 16/887,559 entitled "Floor Covering with Interlocking Design," filed May 29, 2020.
Boo, Christian, et al., U.S. Appl. No. 17/017,085 entitled "Set of Panels," filed Sep. 10, 2020.
Boo, Christian, U.S. Appl. No. 17/067,989 entitled "Floorboards Provided with a Mechanical Locking System," filed Oct. 12, 2020.
Boo, Christian, U.S. Appl. No. 17/076,445 entitled "Set of Panels," filed Oct. 21, 2020.
U.S. Appl. No. 17/094,226, **Kell—See Information Below.
Kell, Richard William, U.S. Appl. No. 17/094,226 entitled "Vertical Joint System for a Surface Covering Panel," filed Nov. 10, 2020.

* cited by examiner

RESILIENT FLOOR

CROSS-REFERENCE TO RELATED APPLICATIONS

This application is a continuation of U.S. application Ser. No. 16/027,465, filed on Jul. 5, 2018, which is a continuation of U.S. application Ser. No. 14/982,608, filed on Dec. 29, 2015, which is a continuation of U.S. application Ser. No. 14/272,895, filed on May 8, 2014, now U.S. Pat. No. 9,249,581, which is a continuation of U.S. application Ser. No. 13/734,406, filed on Jan. 4, 2013, now U.S. Pat. No. 8,756,899, which is a continuation of U.S. application Ser. No. 12/875,293, filed on Sep. 3, 2010, now U.S. Pat. No. 8,365,499, which claims benefit to U.S. Provisional Application No. 61/239,927, filed Sep. 4, 2009. The entire contents of U.S. application Ser. No. 16/027,465, U.S. application Ser. No. 14/982,608, U.S. application Ser. No. 14/272,895, U.S. application Ser. No. 13/734,406, U.S. application Ser. No. 12/875,293 and U.S. Provisional Application No. 61/239,927 are each hereby incorporated by reference in its entirety.

TECHNICAL FIELD

The present invention generally concerns a method of assembling of floorboards provided with a mechanical locking system.

BACKGROUND OF THE INVENTION

Floorboards with a wood based core that are provided with a mechanical locking system and methods of assembling such floorboards by angling-angling, angling-snapping or vertical folding are disclosed in e.g. WO 94/26999, WO 01/77461, WO 2006/043893 and WO 01/75247. Floorboards of resilient material, e.g. PVC, are known, commonly referred to as LVT (Luxury Vinyl Tiles) that are glued down to the subfloor or bonded at the edges to each other WO 2008/008824.

SUMMARY OF THE INVENTION

A method is disclosed for assembling of floorboards, which are so called resilient floorboards i.e. the core is of a resilient material for example vinyl or PVC. The known methods of assembling floorboards that are mentioned above are difficult to use when assembling resilient floorboards since resilient floorboards easily bend which make it hard to use the angling-angling method and it is unfeasible to use the angling-snapping method since it requires a force to be applied, at an opposite edge in relation to the edge of the floorboard which is intended to be connected, by e.g. a hammer and a tapping block and the resilient core of the resilient floorboard absorbs the applied force. The known vertical folding methods are also difficult to apply due to the increased friction in the resilient material. The disclosed method makes the assembling easier and reduces the force needed for connection of the floorboards.

Furthermore, a locking system suitable for the method is disclosed. The locking system decreases the friction forces that must be overcome when installing the resilient floorboards.

An aspect of the invention is a method of assembling resilient floorboards, which are provided with a mechanical locking system, which method comprises the step of:

positioning a floorboard edge, provided with a first device of said mechanical locking system (11), juxtaposed another floorboard edge, provided with a second device of said mechanical locking system (11);

bending (30) the floorboard (2) along the edge; and applying a force (F) on a first part of the floorboard edge, wherein at said first part of the floorboard edge said first device is pushed into said second device to obtain a vertical and horizontal mechanical locking of a part of the floorboards' edges.

The bending makes it possible to finalize the connection of only a part of the edge of the floorboard, instead of the whole edge as in the known methods, and consequently the force needed to assemble the floorboards is considerably reduced.

The bending is preferably achieved by raising an outer part of said edge preferably by positioning of a raising device, e.g. a wedge, or a hand/finger of the assembler under said floorboard. The raised position of the outer part of said edge is preferably maintained during the force-applying step. In a preferred embodiment also the position of the raising device is maintained during the force-applying step.

The method comprises thereafter preferably the step of applying a force to a new part of the edge, which new part is adjacent to the mechanically locked part, and repeating this step until the whole edge is connected to said another edge.

The force is preferably applied by a tool and most preferably by a tool with a rotatable part.

In a preferred embodiment, the first device is an upper locking strip, which is resiliently bendable, with a downwardly protruding locking element and the second device is a lower locking strip provided with an upwardly protruding locking element. The resiliently bendable locking strip facilitates the connection of the floorboards. The downwardly protruding locking element is provided with a locking surface, which cooperates, for horizontal locking, with a locking surface of the upwardly protruding locking element. The locking strips are integrally formed with the resilient floorboards and preferably of the same resilient material. The downwardly and/or the upwardly protruding locking element is preferably provided with a guiding surface which are configured to guide the locking elements in to a position where the floorboards are connected by the locking elements and the locking surfaces cooperate.

The resilient floorboards are in a preferred embodiment made of a bendable thermo plastic, e.g. vinyl, surlyn, and PVC. Floorboards of vinyl are generally referred to as LVT (Luxury Vinyl Tiles). In a most preferred embodiment the thickness of the floorboard is about 4 mm to about 10 mm. If the floorboards are too thin it is hard to produce a locking system integrally in the floorboard material and if they are too thick it is hard to assemble the floorboards with the disclosed method.

The floorboards are in a preferred embodiment provided with an upper decorative layer made of a similar resilient material and most preferably provided with a balancing layer and/or a sublayer.

The force is preferably applied with a tool, which comprises a handle and a press part for applying a force on the floorboard. Preferably, the press part is provided with an outer round or circular shape for applying the force on the floorboard and in the most preferred embodiment the press part is rotatable.

DETAILED DESCRIPTION OF EMBODIMENTS

Figure 1A:
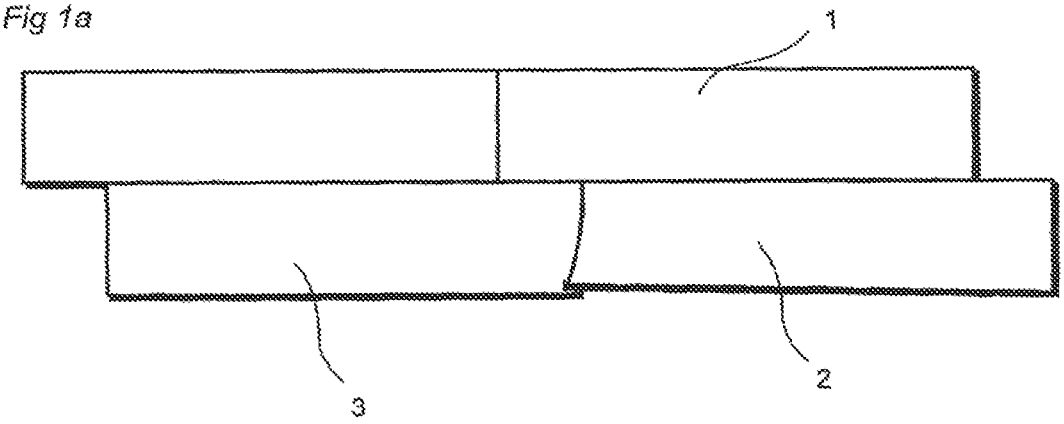
FIGS. 1*a-b* show an embodiment of the assembling method.
Figure 1B:
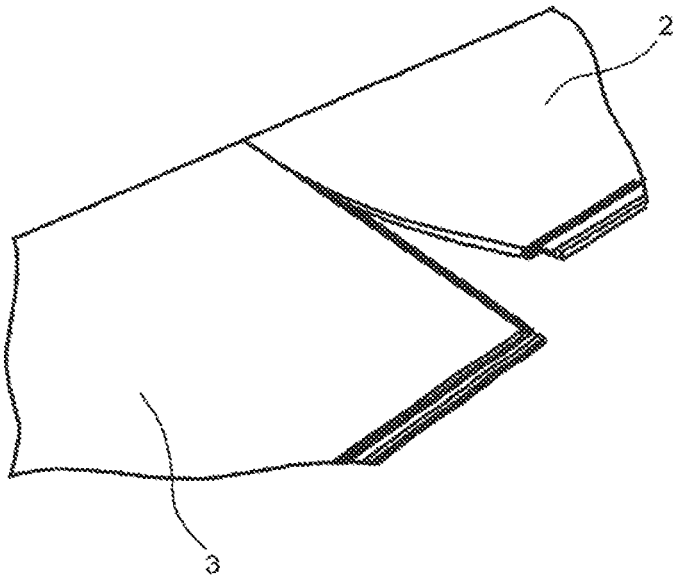

An embodiment of a method of assembling resilient floorboards (1, 2, 3) with a mechanical locking system 11 is shown in FIGS. 1*a* and 1*b*. An edge of a floorboard 2 is positioned juxtaposed another edge of another floorboard 3. The edge of the floorboard is bent (30) along the edge during the assembling and the connection of the floorboard edges to each other. In this embodiment the edge and said another edge are short edges and a long edge of the floorboard is connected to a long edge of a floorboard 1 in another row, by a mechanical angling locking system, simultaneous with the short edge connection, by an angular motion.

Figure 5A:
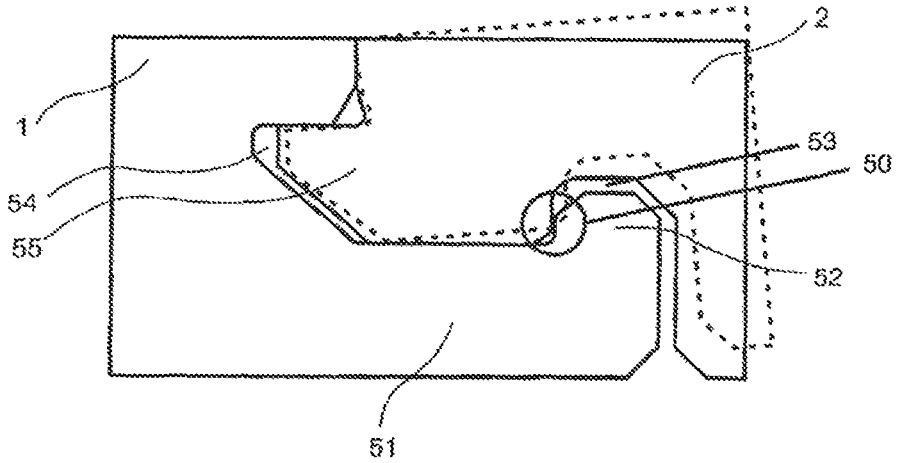
FIGS. 5*a*-5*b* show an embodiment of a locking system configured for connection by angling.
Figure 5B:
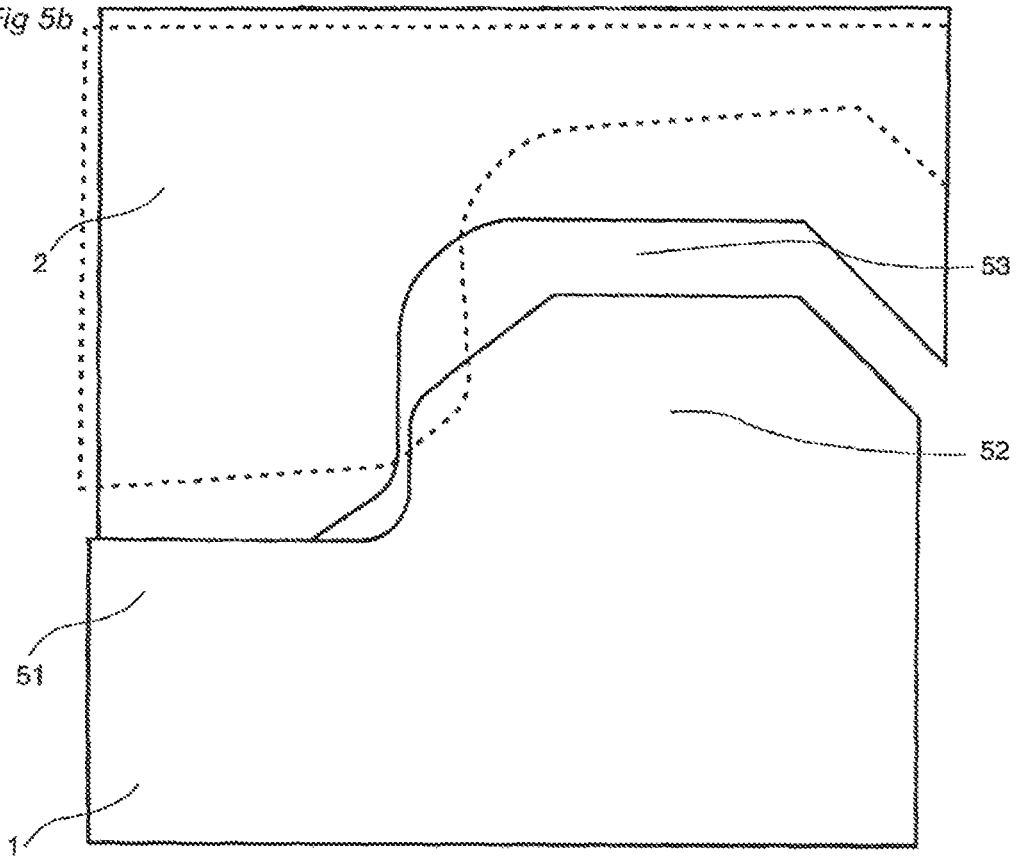

An embodiment of a mechanical angling locking system is shown in FIGS. 5*a* and 5*b*. Embodiments of the mechanical locking system 11 at the short edges is shown in FIGS. 6*a* to 9*a*. When assembling a complete floor the method shown in FIG. 1*a* is naturally applied and repeated for each resilient floorboard, which is provided with the locking system at each short edge and the mechanical angling locking system at each long side, until all resilient floorboards are connected.

The resilient floorboards may also be of square shape with the mechanical locking system 11 provided at two opposite edges of each floorboard and the mechanical angling locking system provided at two other opposite edges of each floorboard. It is also possible to provide floorboards of rectangular shape with the mechanical locking system 11 at the long edges and the mechanical angling locking system at the short edges.

Figure 2A:
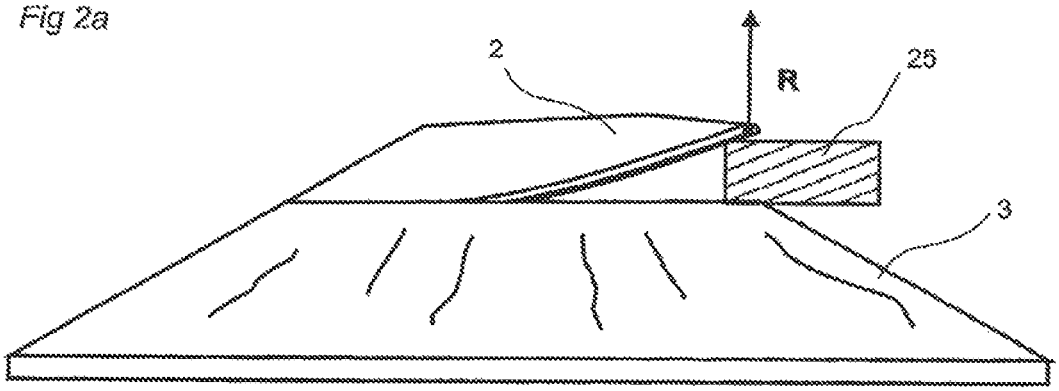
FIGS. 2*a*-2*b* show an embodiment of the assembling method.
Figure 2B:
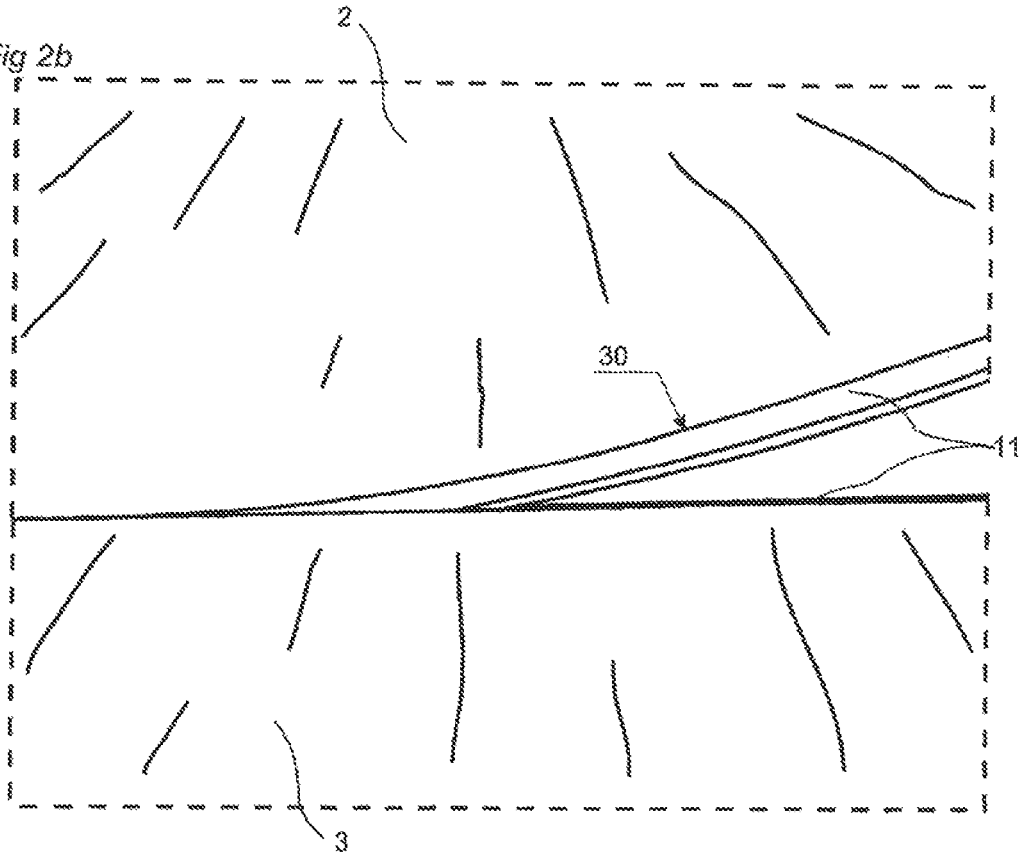
Figure 3A:
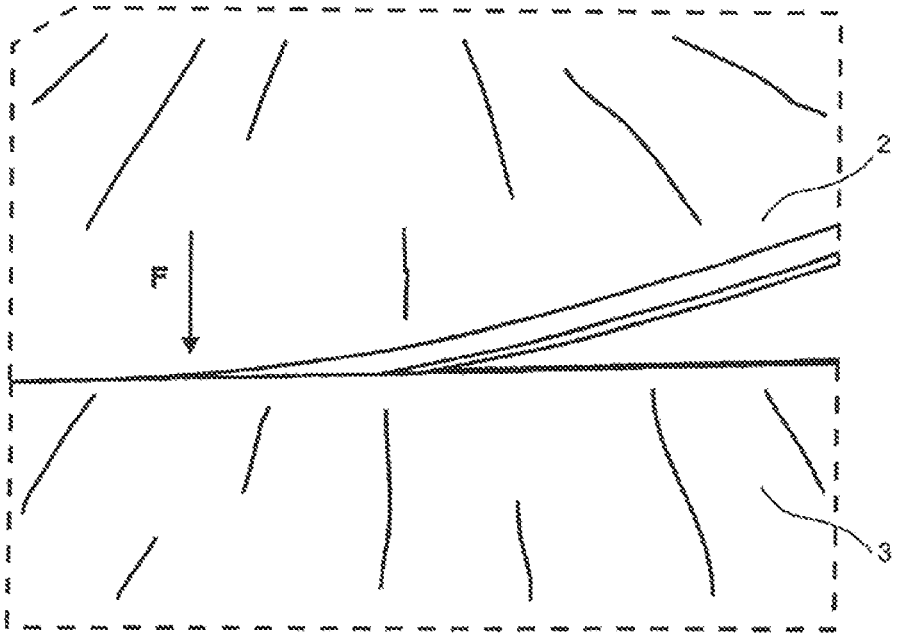
FIGS. 3*a*-3*b* show embodiments of the assembling method.

FIG. 2*a* shows the assembling from another view and FIG. 2*b* shows a detailed view of the bent (30) floorboard 2 edge and that a part of the edge is pressed down such that parts of the floorboards 2,3 are locked to each other by the mechanical locking system 11. The edge is pressed down by applying a vertical force F at the edge on the floorboard, as disclosed in FIG. 3*a*, on a part of the edge which is closest to said another edge, wherein the part of the edge is mechanically locked to another part of said another edge by the mechanically locking system 11. This is repeated until the whole edge is connected vertically and horizontally to said another edge.

The bending of the floorboard makes it possible to finalize the locking of only a part of the edge of the floorboard, instead of the whole edge as in the known methods, and as a result the force required to connect the floorboards is considerably reduced. Since only a part of the edge of the floorboard is locked the area in the mechanical locking system that is in contact during the connection is reduced and consequently the friction created in the mechanical locking is reduced and thereby the force required. The bending is preferably achieved by raising (R) an outer part of said edge by positioning of a raising device (25), e.g. a wedge, or a hand/finger of the assembler under said floorboard. The position of the raising device is maintained during the force-applying step.

Figure 3B:
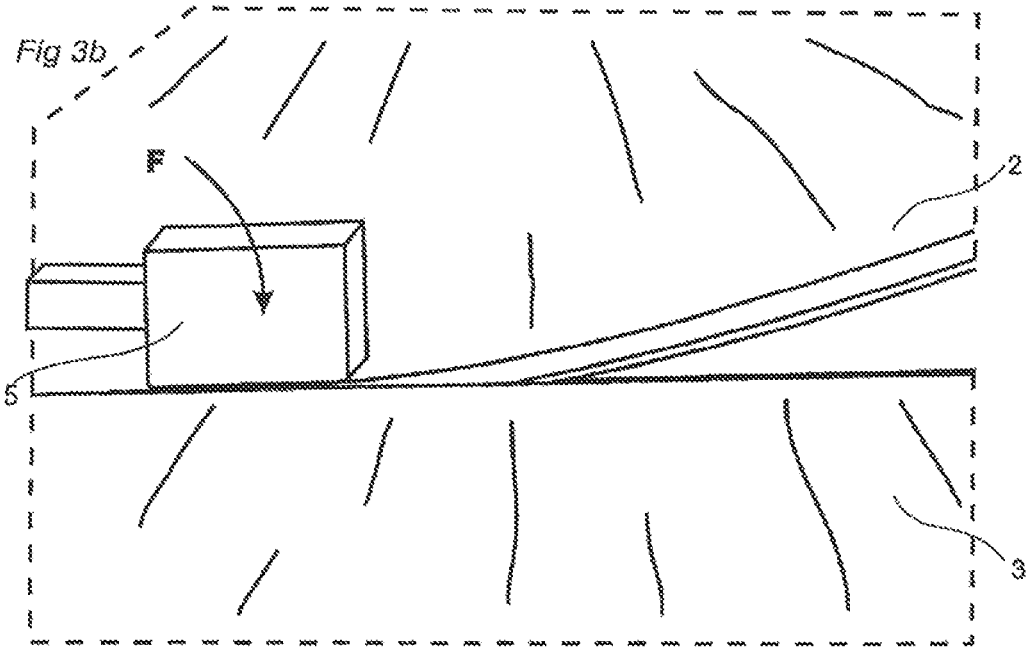
Figure 4A:
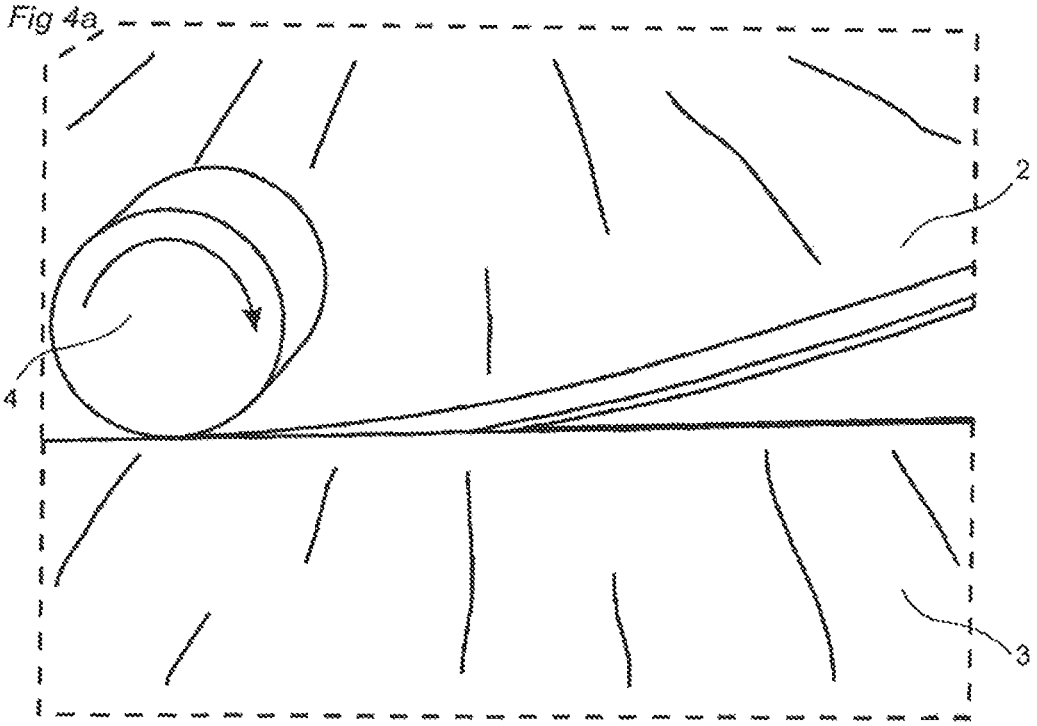
FIGS. 4*a*-4*b* show embodiments of the assembling method.
Figure 4B:
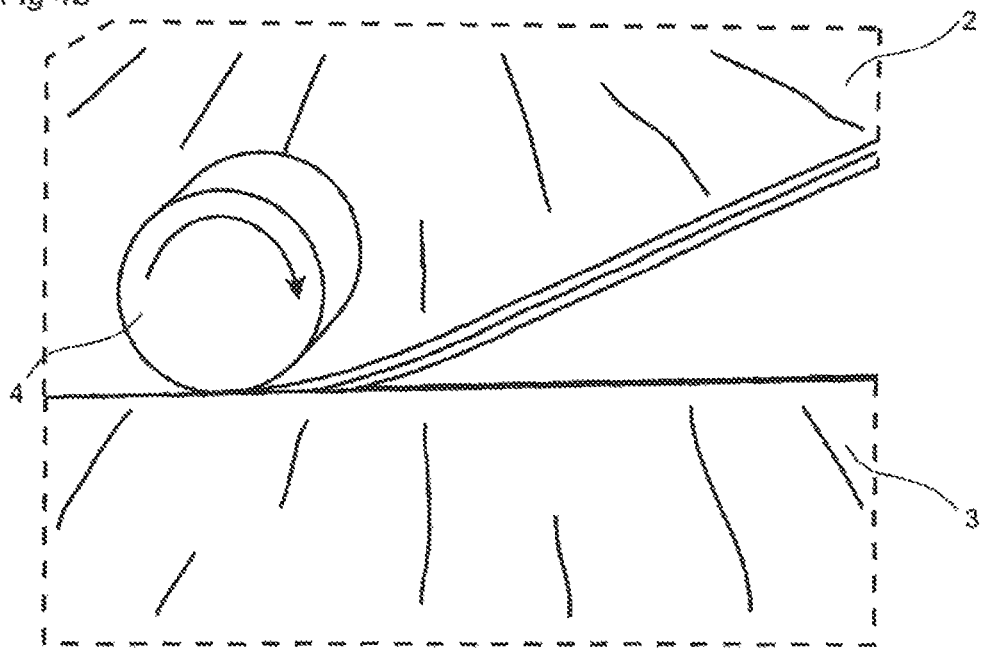

The force may be applied directly, without tools, on the floorboard e.g. by a hand or a foot of the assembler. However, a tool 4,5 may be used to apply the force as disclosed in FIGS. 3*b*, 4*a* and 4*b*. In FIG. 4*b* only a part of the floorboard is bent while the rest of the floorboard edge continues straight in the direction of the tangent of the bent part. Most preferably a tool with a rotatable press part is used to apply the force. FIG. 9*b* shows an embodiment of such a tool.

The floorboard-assembling tool in FIG. 9*b* comprises a handle 93 and press part 94, which is of a circular shape. The rotatable press part 94 makes it easy to move the tool, by one hand of the assembler, along the edge of the floorboard, which is going to be connected, and bend the floorboard with the other hand.

The mechanical angling locking system in FIG. 5*a-b* comprises a locking strip 51, a locking element 52 and a tongue groove 54 at an edge of a resilient floorboard 1 and a locking groove 53 and a tongue 55 at an edge of an adjacent resilient floorboard 2. The tongue 55 cooperates with the tongue groove 54 for vertical locking and the locking element 52 cooperates with the locking groove 53 for horizontal locking, similar to the angling locking systems disclosed in WO 01/77461.

Compared to the locking system, which is produced in a wood based core, disclosed in WO 01/77461 it is possible to produce a mechanical angling locking system in a resilient floorboard with a shorter locking strip and/or higher locking angle and/or increased locking surface area, as disclosed in FIG. 5*b*, which is an enlarged view of area 50 in FIG. 5*a*. This is due to the resilient material, which makes it possible to bend the locking strip more without breaking it. The angling locking system is preferably integrally formed in one piece with the resilient material of the floorboard.

Figure 6A:
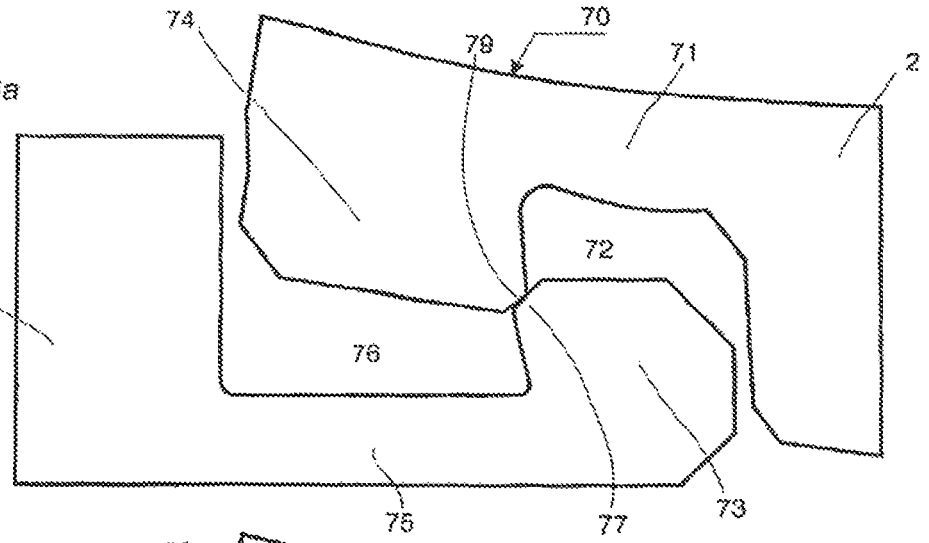
FIGS. 6*a*-6*c* show an embodiment of resilient floorboards during assembling.
Figure 6B:
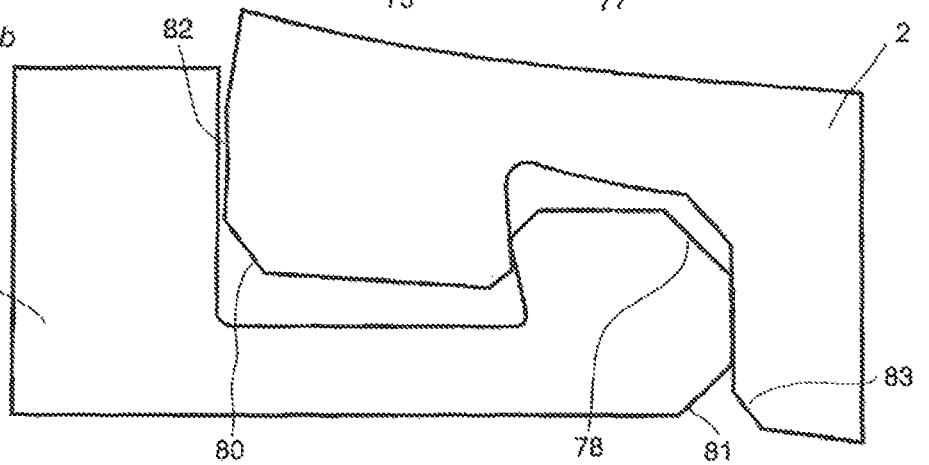
Figure 6C:
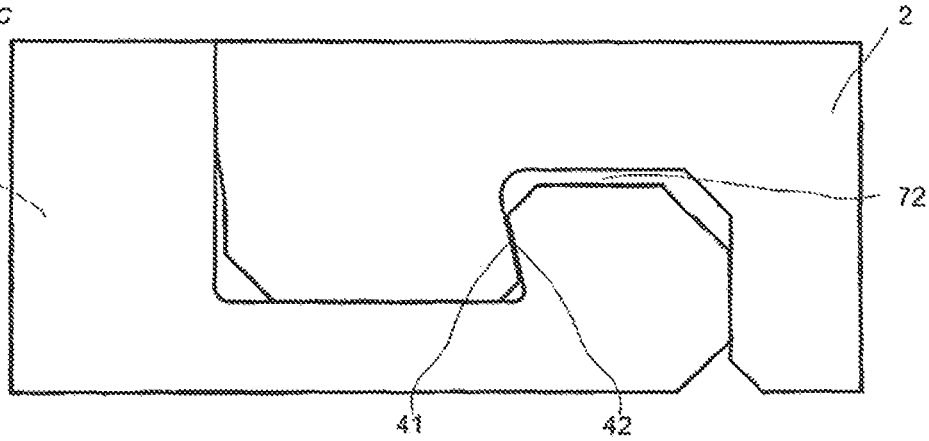

An embodiment of the mechanical locking system is disclosed in FIGS. 6*a*-6*c* in which figures a cross-section of the locking system is shown in three sequential steps during the connection. A first device of the mechanical locking system comprises an upper, and upwardly resiliently bendable, locking strip 71 at an edge of a floorboard 2 and a second device of the mechanical locking system comprises a lower locking strip 75 at an edge of another floorboard 3. The upper and the lower locking strip is provided with a downwardly and an upwardly protruding locking element 74, 73 respectively. The locking elements are provided with locking surfaces 41, 42 configured to cooperate for horizontal locking of the floorboards.

An upwardly bending of the upper locking strip 71 across the edge (see FIGS. 6*a*-6*b*), facilitates a positioning of the downwardly protruding locking element 74 between the upwardly protruding locking element and an upper edge of the floorboard 3 in a position where the locking surface cooperates, as shown in FIG. 6*c*.

The downwardly protruding locking element is preferably provided with a guiding surface 79, which is configured to cooperate (see FIG. 6*a*) with the upwardly protruding locking element 73 in order to facilitate the positioning.

Preferably, the upwardly protruding locking element 73 is provided with another guiding surface 77, which is configured to cooperate (see FIG. 6*a*) with the guiding surface 79 to further facilitate the positioning.

It is also possible to only provide the upwardly protruding locking element 73 with a guiding surface, which is configured to cooperate with an edge of the downwardly protruding locking element.

The angle 44 of the guiding surface 79 and the angle of 43 said another guiding surface 77 are preferably more than about 30° and most preferably more than about 45°.

In a preferred embodiment the mechanical locking system is provided with one or more additional guiding surfaces, which guide the floorboards to the correct location for connection:

- a guiding surface 80 at the downwardly protruding locking element, which guiding surface cooperates with an upper edge of the said other floorboard; and
- a guiding surface 83 at the lower edge of the floorboard, which guiding surface cooperates with an edge or a guiding surface of the upwardly protruding locking element.

A space 81, shown in FIG. 6*b*, under the upwardly protruding locking element facilitates bending of the lower locking strip during the connection of the lower locking strip. A space 72 above the upwardly protruding locking element ensures a proper connection of the floorboards, without risking that the floorboard is prevented reaching the position were the upper surfaces of the floorboards are in the same plane.

Figure 7A:
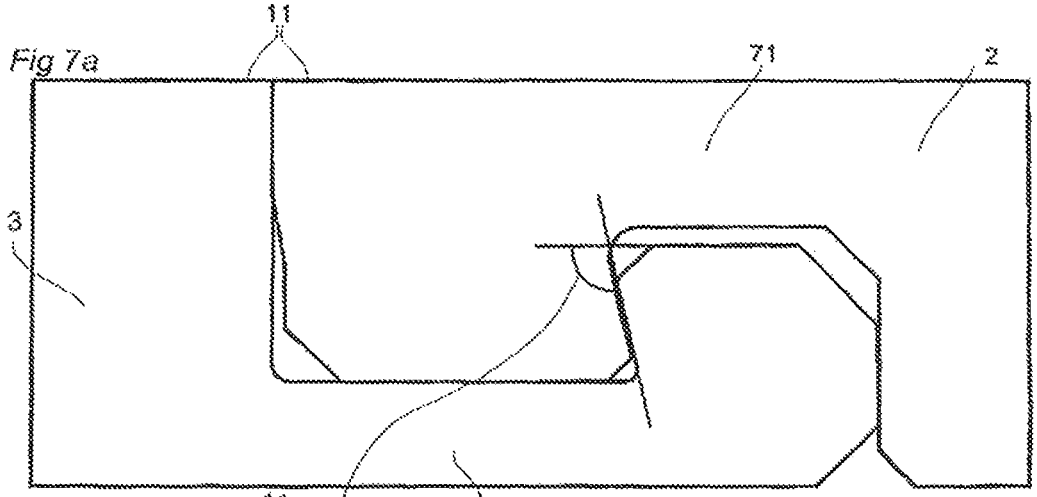
FIGS. 7*a-c* show embodiments of a locking system for resilient floorboards.
Figure 7B:
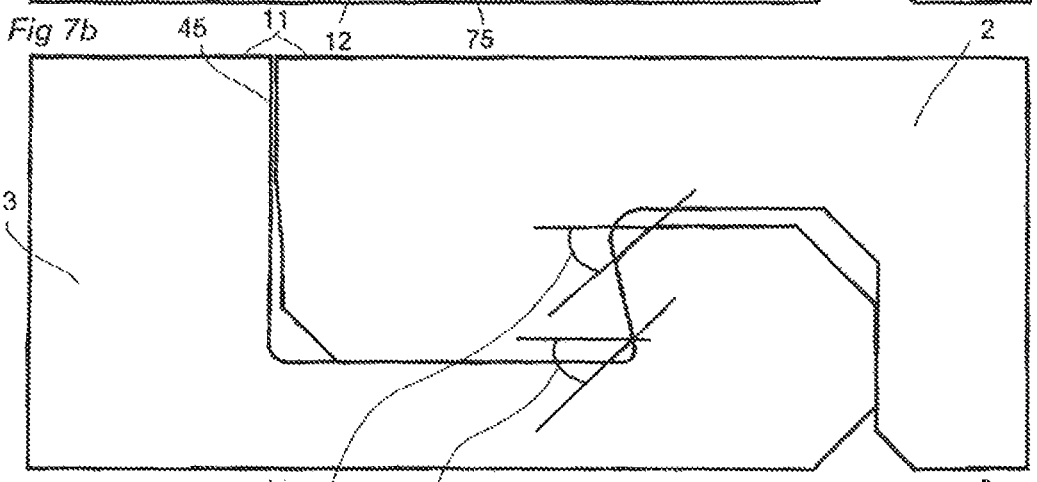
Figure 7C:
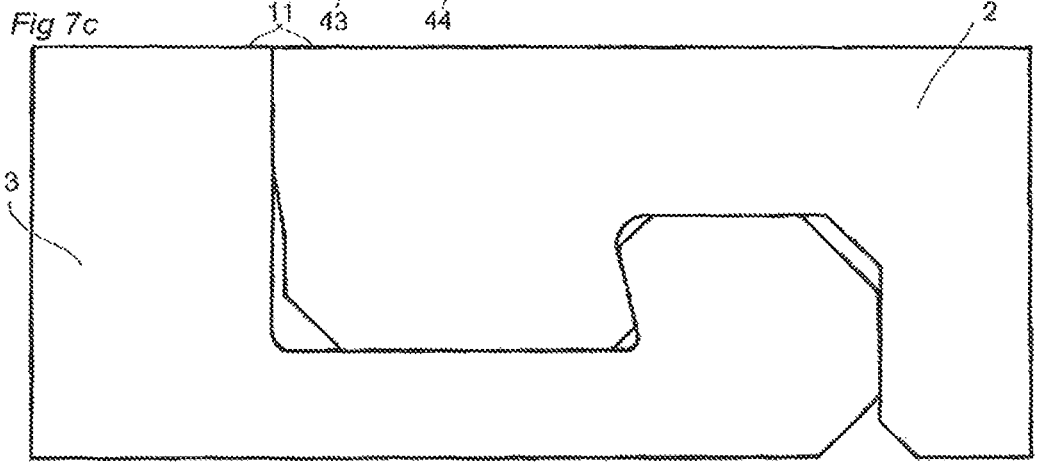
Figure 8A:
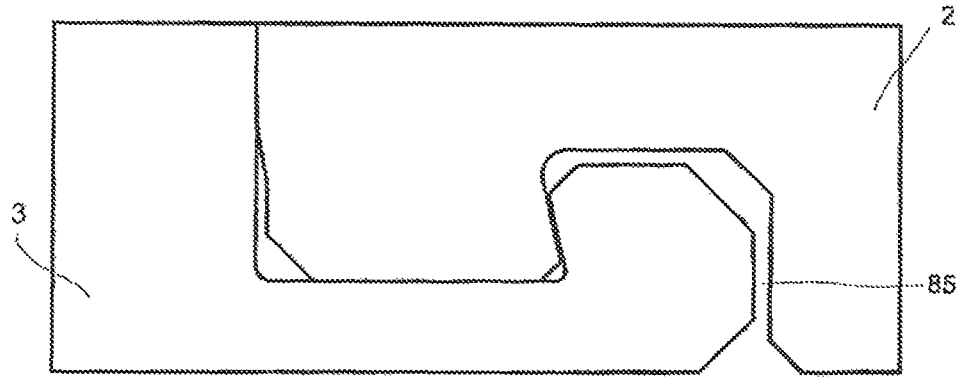
FIGS. 8*a-c* show embodiments of a locking system for resilient floorboards
Figure 8B:
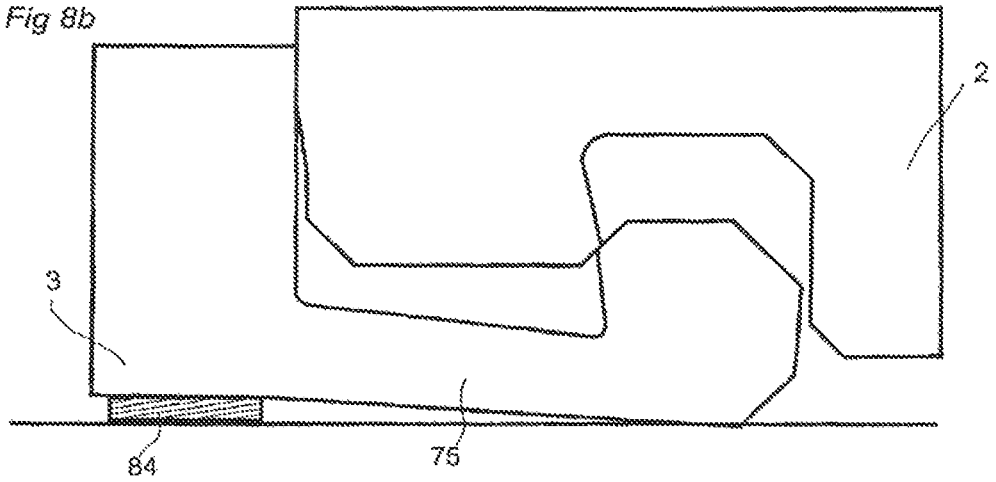
Figure 8C:
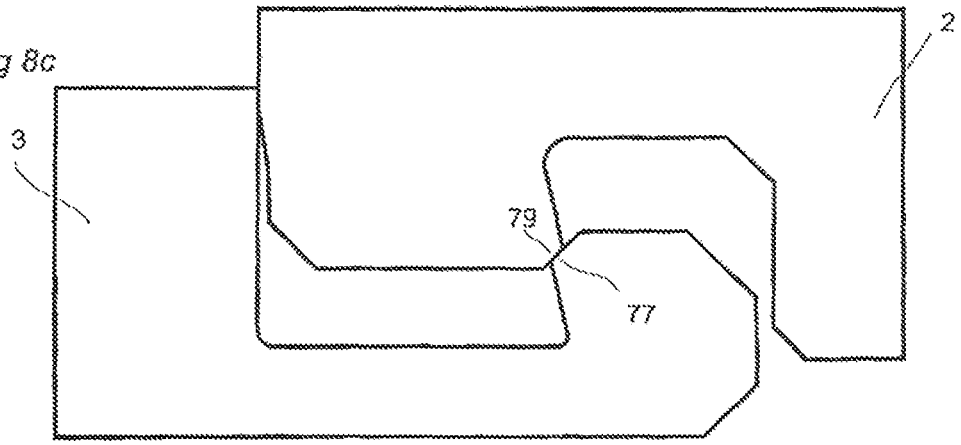

The number and area of the contact and locking surfaces should generally be minimized to ease connection of the floorboards. A small play 45 between the top edges of the floorboards (see FIG. 7*b*, 45) makes them easier to install, but a tight (see. FIG. 7*a*) fit increases the vertical locking strength. To achieve a connection which is more resistant to moisture it is possible to have contact surfaces and a tight fit between the between the lower edges of the floorboards, which also increases the vertical and horizontal locking strength. However, the tight fit also makes it harder to connect the floorboards and a space (see FIG. 8*a-c*, 85) makes it easier. An even more moisture resistant connection is achieved if the space 72 above the upwardly protruding locking element is eliminated (see FIG. 7*c*).

The angle 12 between the locking surfaces and the upper surface of the floorboards are preferably more than 90° to obtain a vertical locking in the position where the locking surface cooperates.

The locking strips 71, 75 are integrally formed in the floorboard, and preferably the whole locking system is integrally formed in one piece with the resilient material of the floorboard. However, it is possible to add separate pieces to increase the locking strength, e.g. in the form of a tongue of stiffer material, of e.g. plastic or metal of e.g. aluminum, preferably for the vertical locking.

A downwardly bending across edge of the lower locking strip 75 (see FIG. 8*b*) further facilitates the positioning of the locking elements in the position where the locking surface cooperates. Bending of the lower strip is preferably achieved by positioning of a spacer 84 between the floorboard edge and the subfloor, and inside the lower locking strip such that the lower locking strip can bend freely. It is also possible to produce a lower locking strip whose lower part is removed to create a free space between the subfloor and lower the locking strip. However, that also reduces the bending strength of the locking strip, which is not desirable since a locking strip of resilient material, e.g. vinyl, has a relatively weak resilient strength. A reduced bending strength of the locking strip means a reduced locking strength of the locking system.

Figure 9A:
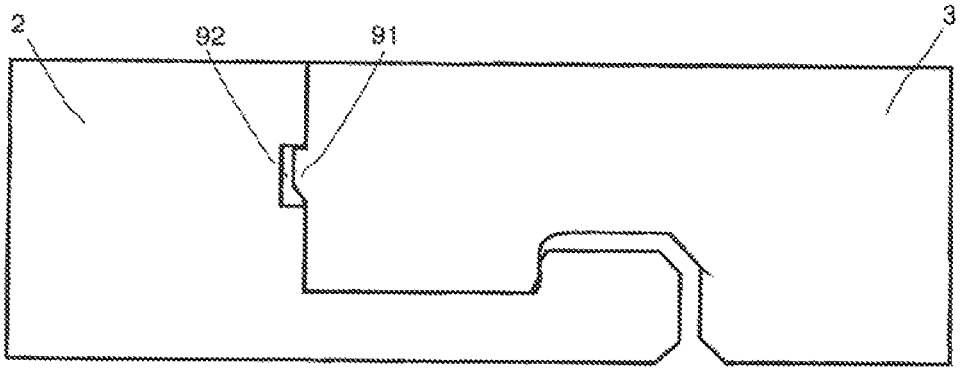
FIGS. 9*a-b* show an embodiment of a locking system and an embodiment of the assembling tool.
Figure 9B:
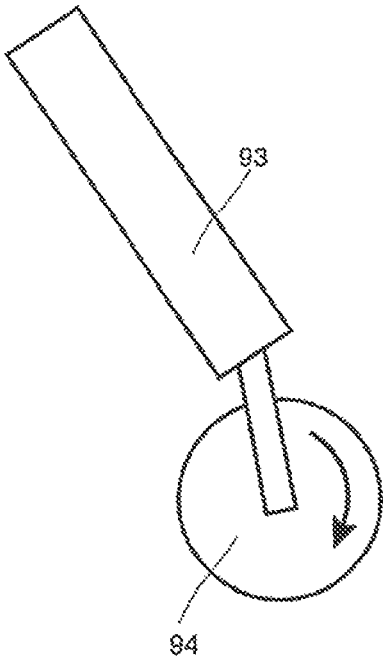

FIG. 9*a* shows an embodiment comprising a tongue 91 at the edge of a floorboard, cooperating with a tongue groove 92 at the edge of an adjacent floorboard, cooperating for vertical locking of the floorboards. The embodiment in FIG. 9*a* is provided with the tongue at the edge of the floorboard with the upper locking strip and the tongue groove at the edge of the floorboard with the lower locking strip. However it is also possible to provide the tongue at the edge of the floorboard with the lower locking strip and the tongue groove at the edge of the floorboard with the upper locking strip. These

The invention claimed is:

1. A method of assembling resilient floorboards, wherein the floorboards each include a core made of a thermoplastic material, each floorboard comprises a mechanical locking system for vertical and horizontal locking to an adjacent floorboard, wherein the mechanical locking system is integrally formed in one piece with core, wherein the mechanical locking system comprising a first device at a first edge, and a second device at a second edge, wherein the method comprises:

- connecting an adjacent edge of the first floorboard to a juxtaposed edge of a third floorboard in another row by angling;
- positioning the first edge of a first floorboard juxtaposed the second edge of a second floorboard so that the first device of the mechanical locking system overlies the second device, the first edge having an outermost surface closest to the second edge of the second floorboard;
- bending the first floorboard along the first edge so that the first edge has an axis of curvature that is perpendicular to the second edge of the second floorboard, the curvature being convex toward the bottom surface of the floorboards;
- applying a force on a first part of the first edge, wherein at said first part of the first edge said first device is pushed into said second device to obtain a vertical and horizontal mechanical locking of a part of the first and second edges; and
- applying a force to a new part of the first edge, which new part is adjacent to said first part to reduce the overall force required to mechanically lock the first edge to said second edge of the second floorboard, and repeating this step until the whole first edge is vertically and horizontally locked to said second edge.

2. The method according to claim 1, wherein the bending is achieved by raising at least a part of the outermost surface of said first edge.

3. The method according to claim 2, wherein the raising is achieved by positioning of a raising device under said first floorboard in order to raise the part of the outermost surface of the first edge with respect to the juxtaposed second edge of the second floorboard.

4. The method according to claim 1, wherein the force is applied to a part of the first edge that is unlocked and closest to said second edge.

5. The method according to claim 1, wherein the force is applied by a tool.

6. The method according to claim 5, wherein the force is applied by a rotating part of the tool.

7. The method according to claim 1, wherein the first device comprises an upper locking strip and the second device comprises a lower locking strip, the upper and the lower locking strips are comprises a downwardly and an upwardly protruding locking element, respectively, each locking element comprises a locking surface configured to cooperate for horizontal locking of the floorboards, wherein the method comprises bending of the upper locking strip to a convex shape towards a bottom surface of the first floorboard during locking.

8. The method according to claim 7, wherein the lower locking strip is downwardly resiliently bendable in order to facilitate the positioning.

9. The method according to claim 7, wherein the downwardly protruding locking element comprises a first guiding surface, which is configured to cooperate with the upwardly protruding locking element in order to facilitate the positioning.

10. The method according to claim 9, wherein the first guiding surface cooperates with a second guiding surface of the upwardly protruding locking element, which said second guiding surface is configured to facilitate the positioning.

11. The method according to claim 10, wherein the angle of the first guiding surface is more than about 30 degrees.

12. The method according to claim 10, wherein the angle of the first guiding surface is more than about 45 degrees.

13. The method according to claim 10, wherein the angle of said second guiding surface is more than about 30 degrees.

14. The method according to claim 10, wherein the angle of said second guiding surface is more than about 45 degrees.

15. The method according to claim 7, wherein the angle between the locking surfaces and the upper surface of the floorboards is more than 90 degrees to obtain a vertical locking in a position where the locking surfaces cooperate.

16. The method according to claim 7, wherein the first edge comprises a tongue and the second edge comprises a groove for vertical locking of the floorboards.

17. The method according to claim 7, wherein the first edge comprises a groove and the second edge comprises a tongue for vertical locking of the floorboards.

18. The method according to claim 8, the method further comprising bending the lower locking strip.

19. The method according to claim 18, wherein the bending of the lower locking strip is achieved by positioning a spacer between the second floorboard and the subfloor and offset from the lower locking strip such that the lower locking strip can bend freely.

* * * * *